United States Patent [19]

Sturman et al.

[11] 4,409,638

[45] Oct. 11, 1983

[54] INTEGRATED LATCHING ACTUATORS

[76] Inventors: Oded E. Sturman, c/o Kineret Engineering, 9819 Etiwanda Ave.; Benjamin Grill, 9819 Etiwanda Ave., both of Northridge, Calif. 91325; Lynn Harrison, 23554 Cherry St., Newhall, Calif. 91321

[21] Appl. No.: 311,174

[22] Filed: Oct. 14, 1981

[51] Int. Cl.[3] ..... H01H 47/32

[52] U.S. Cl. ..... 361/152; 251/137; 361/191

[58] Field of Search ..... 361/152, 154, 155, 156, 361/160, 191; 251/129, 137

[56] References Cited

U.S. PATENT DOCUMENTS

| | | | |
|---|---|---|---|
| 4,065,096 | 12/1977 | Frantz et al. | 361/152 X |
| 4,257,081 | 3/1981 | Sauer et al. | 361/156 |
| 4,344,103 | 8/1982 | Nagamoto et al. | 361/160 |

FOREIGN PATENT DOCUMENTS

| | | | |
|---|---|---|---|
| 54-130872 | 10/1979 | Japan | 361/152 |
| 600518 | 6/1978 | Switzerland | 361/155 |
| 1447494 | 8/1976 | United Kingdom | 361/191 |

*Primary Examiner*—Harry E. Moose, Jr.

*Attorney, Agent, or Firm*—Blakely, Sokoloff, Taylor & Zafman

[57] ABSTRACT

Integrated latching actuators are disclosed which may be used as direct replacements for nonlatching actuators in various applications. The integrated latching actuators comprise a magnetically latching actuator with control electronics packaged therewith so that actuation and release may be controlled through a single control line. The integration of the actuator and control electronics eliminates many potential failure modes of conventional latching actuators and results in greatly reduced power consumption, particularly in low duty cycle applications. Various embodiments are disclosed, including embodiments that may operate directly on microprocessor outputs without special drive circuitry.

11 Claims, 12 Drawing Figures

INTEGRATED LATCHING ACTUATORS

BACKGROUND OF THE INVENTION

1. Field of the Invention

The present invention relates to the field of latching actuators.

2. Prior Art

Various types of latching actuators are well known in the prior art. By way of example, U.S. Pat. No. 3,683,239 discloses a self-latching solenoid actuator having a low power consumption and an internal switching arrangement whereby latching and unlatching may be accomplished by such means as a simple single pole double throw remote switch. In accordance with that disclosure the solenoid has a permanent magnet in the magnetic circuit thereof so that an actuating current in a first direction will actuate the solenoid and charge the permanent magnet, and a smaller current in the opposite direction will demagnetize the permanent magnet and allow a return spring to force the plunger to the fully extended position. A single pole double throw switch electrically coupled to the solenoid coil is disposed adjacent to the magnetic circuit and mechanically coupled to the solenoid plunger. The switch is coupled in circuit so as to be operative to turn off the actuating current and the unlatching current as the plunger approaches the latched and unlatched positions respectively, and to reconnect the solenoid coil in preparation for the next operating signal. Systems of this general form have been used commercially in sprinkler systems, such as those of U.S. Pat. No. 3,821,967 and 3,989,066.

One disadvantage of the foregoing system is the inclusion of the mechanical switch which introduces a mechanical failure mode as a result of the possible switch failure and/or improper switch positioning during the manufacturing process. The system also has the disadvantage that the actuator-mechanical switch combination is basically a three wire combination so that the turn on signal is provided through one line and set of switch contacts whereas the turn off signal is provided through a second line and a second set of switch contacts (the third line providing a return or ground). The three wire system is not of any particular disadvantage in sprinkler systems of the type hereinbefore referred to, though obviously, a three wire device is not compatible with control systems hereinbefore operating a conventional two lead nonlatching actuator, and is not directly interchangeable with such prior art nonlatching actuators.

Further, while control systems may be designed to control three wire actuators of the type hereinbefore described, the use of such three wire actuators, whether of this or of any other design, introduces additional required mechanism and/or circuitry and introduces failure modes which in most applications are not acceptable. In particular, conventional actuators actuate upon the application of a voltage thereto and release when the voltage is removed. Accordingly, a simple time clock or equivalent mechanism or circuit providing a simple switch closure between the actuator and a source of power for actuation and the opening of the same switch for release of the actuator will be all that is required. If one of the two leads is broken or the time clock switch is nonoperative, the actuator will remain in the released position. However in the three wire system of the general type described, one time clock switch must be provided to provide the turn on pulse and a second time clock switch must be provided to provide the turn off pulse. In addition to the additional mechanism and interconnections, the three wire system has the further disadvantage that a failure of the release time clock switch or the line carrying the release signal will still allow actuation of the actuator without a controllable subsequent release thereof, frequently a highly undesirable result because of the mechanical function of the actuator.

By way of a specific example, conventional actuators are used on the inlet water valve of household dishwashers. In a conventional system, when power is applied to the actuator (a two wire device), the actuator is actuated turning on the valve, and when power is removed therefrom, whether by way of intentional control or system failure, the valve will close. While it is true that the valves may stick and therefore fail to close, even though power is removed, the valve normally is only kept open for a minute or so at a time so that it has little time to freeze in the open position, i.e., if it turned on after sitting for a day or more, it should be capable of turning off shortly thereafter. In a three wire system of the general type described however, there are various types of failure modes such as the failure of the switch to provide the release pulse to the latching actuator and an open or poor contact on the third line. In any such failure, a water valve controlled by the actuator would remain on, leading to much more serious problems than a mere failure to actuate. Accordingly, while latching actuators have a number of very substantial advantages, in such applications they have not generally been used because of these problems.

One of the potential advantages of latching actuators in most applications is that the actuators may be considerably smaller than the corresponding nonlatching actuator because of their very low power consumption and energy dissipation in low duty cycle applications. In particular, nonlatching actuators must be held actuated during the entire actuated time period, normally with the number of ampere turns in the actuator coil approaching or equal to that which was required for actuation of the device when the air gap in the magnetic path was at its greatest. This results in considerable $I^2R$ loss in the actuator coil, putting definite limitations on the minimum size coil and core that can be used. On the other hand, the current in a latching actuator coil only flows for a few milliseconds when the actuator is actuated, and a few more milliseconds when the actuator is released so that the instantaneous power dissipated in the coil may be much larger during the moments of actuation and release than could be tolerated if such current had to be sustained during the entire actuated time period. Thus, smaller cores and smaller coils may be used in a latching actuator used to replace a nonlatching actuator provided no substantial additional failure modes are introduced, particularly those failure modes which would be likely to leave the actuator in the actuated position.

BRIEF SUMMARY OF THE INVENTION

Integrated latching actuators are disclosed which may be used as direct replacements for nonlatching actuators in various applications. The integrated latching actuators comprise a magnetically latching actuator with control electronics packaged therewith so that actuation and release may be controlled through a single control line. The integration of the actuator and control electronics eliminates many potential failure modes of conventional latching actuators and results in greatly reduced power consumption, particularly in low duty cycle applications. Various embodiments are disclosed, including embodiments that may operate directly on microprocessor outputs without special drive circuitry.

DETAILED DESCRIPTION OF THE INVENTION

Figure 1:
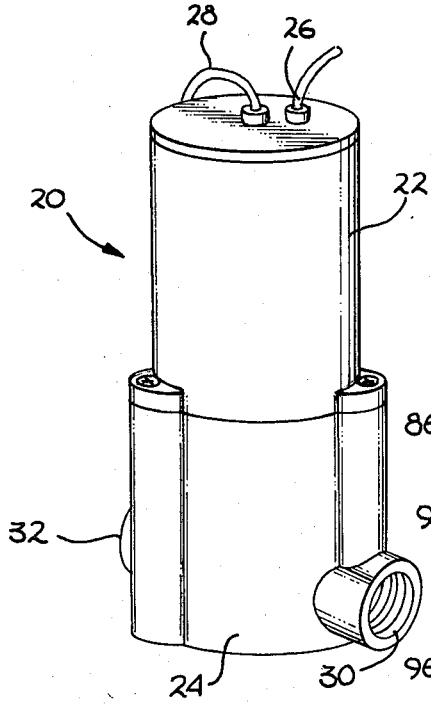
FIG. 1 is a perspective view of a solenoid valve in accordance with the present invention.

First referring to FIG. 1, one embodiment of the integrated latching actuator of the present invention may be seen. This embodiment is combined with a pilot operated valve so as to form a replacement for conventional solenoid operated valves. The integrated latching actuator 20 of this embodiment is characterized by an upper actuator and electronics section 22 and a lower pilot operated valve section 24. As with a conventional nonlatching actuator, the integrated latching actuator has two wires 26 and 28 coming therefrom, one of which is a ground lead and one of which is the main actuating signal lead. This is to be distinguished from conventional latching actuators which normally have three leads, one for the turn on pulse, one for the turn off pulse, and one as a signal return or ground.

Figure 2:
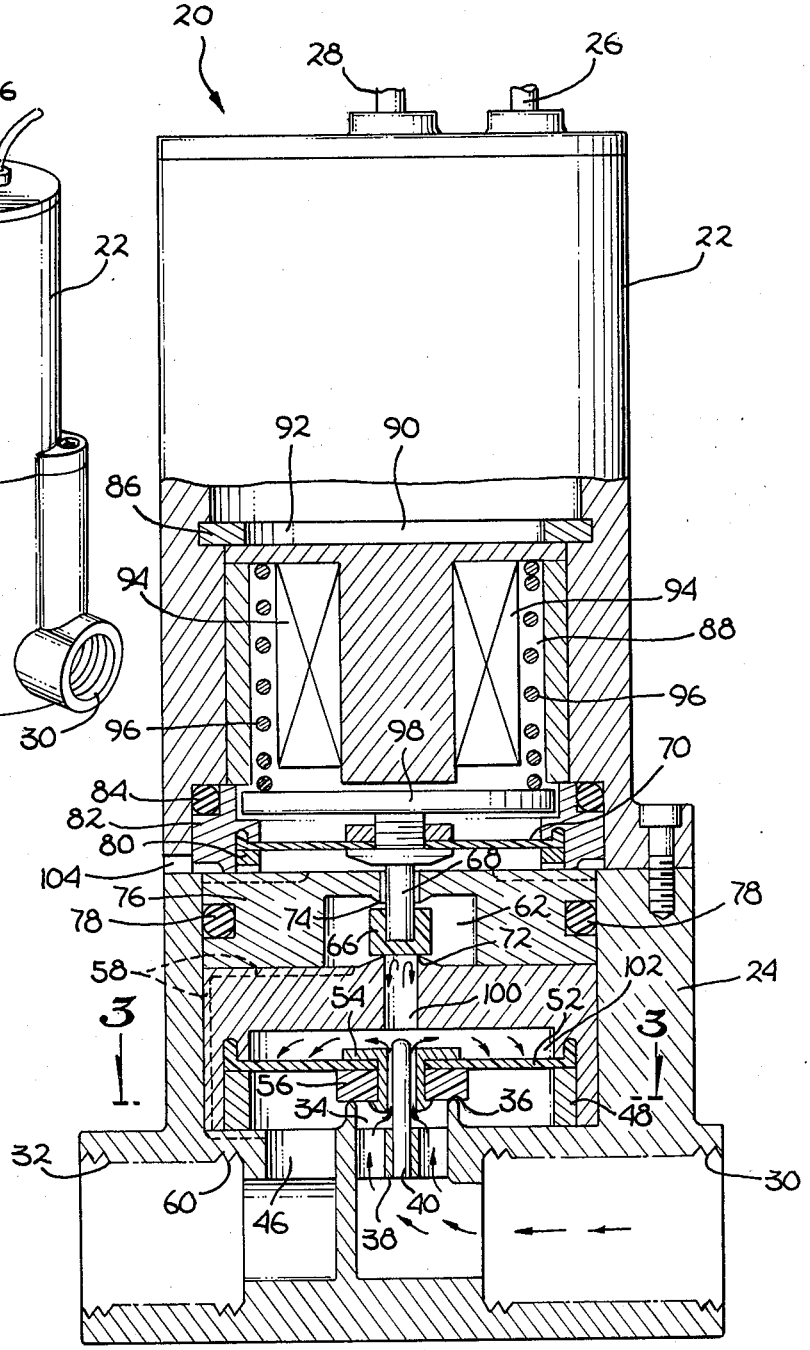
FIG. 2 is a partial cross section taken on an expanded scale of the solenoid valve of FIG. 1 illustrating the internal components thereof in the valve closed (actuator released) position.
Figure 3:
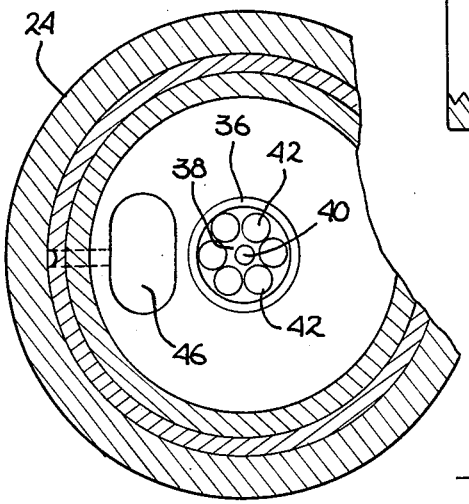
FIG. 3 is a view taken along line 3—3 of FIG. 2.
Figure 4:
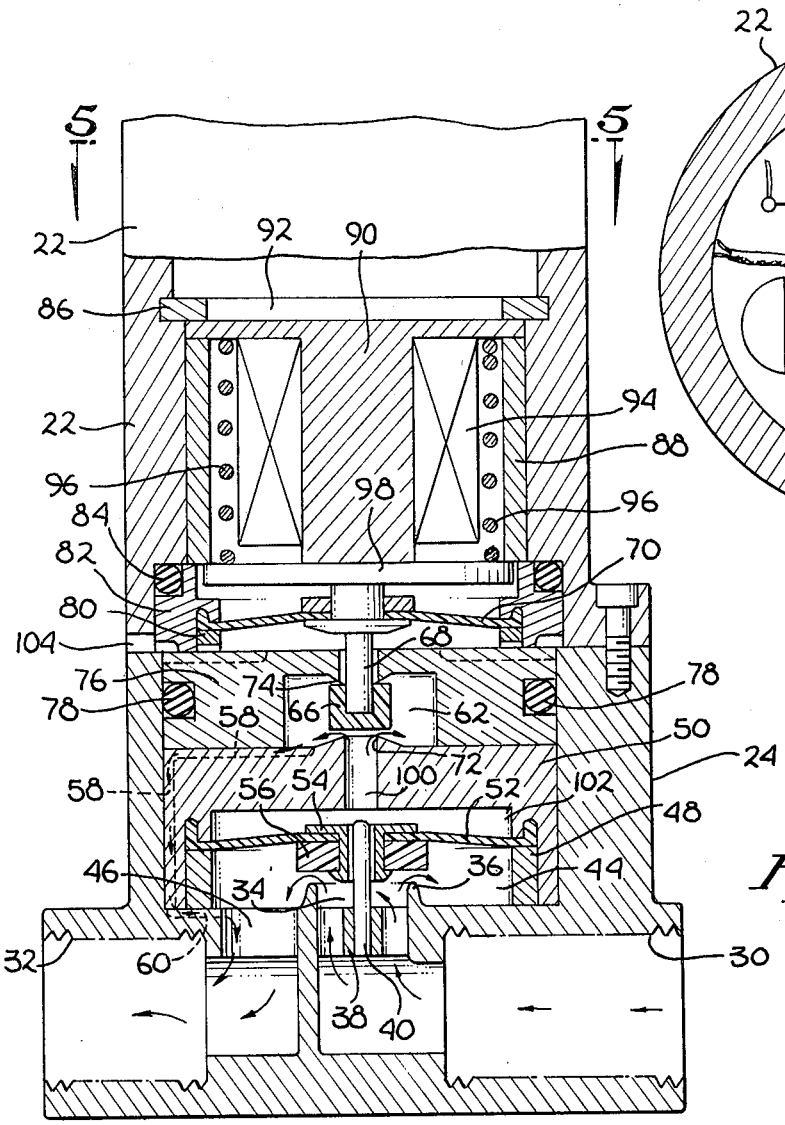
FIG. 4 is a cross section similar to the cross section of FIG. 2 though illustrating the internal components of the valve in the valve open (actuator actuated) position.

The magnetic and valve portion of the actuator of FIG. 1 may be seen in FIGS. 2 through 4. In particular, FIGS. 2 and 4 are partial cross sections taken on an expanded scale, illustrating the internal elements of the magnetic and valve portions, with FIG. 3 being a view taken along line 3—3 of FIG. 2 to illustrate the structure of a portion of the valve mechanism. FIG. 2 illustrates the valve in the closed position and the manner in which the inlet pressure holds the valve in the closed position, while FIG. 4 illustrates the valve in the open position. The valve body 24 is preferably a molded plastic (or metal) body with a threaded inlet port 30 and threaded outlet port 32. The inlet port 30 is in communication with region 34 bounded by a valve seat 36. A member 38 is disposed in the lower portion of region 34 to support a pin 40, the function of which will subsequently be described. The top view of member 38 may be seen in FIG. 3, wherein it may be seen that member 38 has a plurality of openings 42 therein through which fluid may flow from the inlet port 30 to region 34 in a substantially unrestricted manner. Region 44 in turn is in communication with the outlet port 32 through an opening 46 internal to the body 34. Mounted between a spacer member 48 and member 50 is a flexible diaphragm 52 having a central opening therein containing a flanged member 54, a hard plastic or metal member, which in turn retains a rubber or rubber-like sealing member 56. The flanged member 54 has a central hole therethrough a few thousandth of an inch larger than pin 40 so as to define a relatively low flow rate leakage path between the pin and the internal diameter of flange member 54. As shall subsequently be seen, since the pin 40 is stationary in the structure, though on operation of the valve the diaphragm 52 moves up and down, the clearance between the pin 40 and the flange member 54, while quite small, has a self cleaning action because of the relative motion therebetween to prevent clogging of the small anular flow path.

Member 50 has a plurality of grooves 58 in its upper and side surfaces which in conjunction with grooves 60 in the body 24 define a flow path between region 46 and region 62, and thus between the outlet port 32 and region 62 so that the pressures in these two regions are substantially equal. A second rubber or rubber-like sealing member 66 is disposed on pin 68 supported from above on diaphragm 70. The sealing member 66 (and the structure from which it is supported, such as pin 68 and diaphragm 70) is moveable between a lower position shown in FIG. 2 so as to engage and seal against a valve seat 72 and an upper position so as to engage and seal against a valve seat 74 as shown in FIG. 4, the valve seat 74 being integral with member 76 sealed at its outer periphery to the inside of the body 24 by O-ring 78. Diaphragm 70 is supported at its periphery by a ring 80 and member 82, which in turn is sealed against the upper body 22 by O-ring 84. Trapped between the upper inner portion of member 84 and a snap ring 86 in body member 22 is a stator or stationary portion of a magnetic actuator comprising cylindrical portion 88, central portion 90 and top portion 92. An actuator coil 94 fits around the central portion 90, with a coil spring 96 between the outer periphery of the coil 94 and the inside diameter of member 88 operative on the magnetic moving member 98 so as to force the moving member downward as shown in FIG. 2 when the magnetic circuit comprising portions 88, 90, 92 and 98 are not magnetized.

Items 88, 90, 92, 94 and 98 comprise, in the preferred embodiment, the latching actuator in accordance with U.S. Pat. No. 3,743,898 and accordingly, only a limited description of the actuator is provided herein. It is to be noted however, that the actuator operates on a current pulse through coil 94 to magnetize the magnetic circuit to draw the moving member 98 to the position shown in FIG. 4 wherein the air gap of the magnetic circuit is substantially zero, whereby the retentivity of the parts of the magnetic circuit, while not large in this embodiment, will still provide a high latching force to retain the moveable member 98 in the position shown in FIG. 4 indefinitely after the actuation pulse has been removed. For release of the actuator, a controlled pulse of lesser magnitude is utilized to substantially demagnetize the circuit whereby coil spring 96 will force the movable member 98 to the position shown in FIG. 2. In other embodiments, separate coils may be used for the turn on and the turn off current pulses and/or a permanent magnet may be used whereby the relativity of the magnetic circuit will be high, though still operating in the same manner.

The operation of the valve is as follows. When the magnetic circuit is demagnetized, the moving member 98 of the actuator is in the lower position, shown in FIG. 2, due to the force of spring 96 thereon. This forces sealing member 66 against the valve seat 72 so that opening 100 is closed off at the top thereof. The elasticity of diaphragm 52 (and/or a coil spring provided for this purpose) encourages the diaphragm downward, cavity 102 above the diaphragm taking on additional fluid by leakage in the annular region between pin 40 and flange member 54. As sealing member 56 approaches valve seat 36, the outlet pressure in region 44 begins dropping because of the reduced flow, while the pressure in region 102 tends to increase as region 102 becomes increasingly in direct communication with the inlet port. Thus the increasing pressure differential between regions 102 and 44 encourages closure of the valve and the holding of the valve in the closed position as shown in FIG. 2.

On actuation of the actuator, i.e., magnetization of the magnetic circuit, the moving element 98 of the actuator moves upward to the position shown in FIG. 4, with sealing member 66 moving upward to seal against the valve seat 74 to prevent fluid from passing from region 62 into the region just below diaphragm 70. The movement of the sealing member 66 off of the valve seat 72 vents region 102 through opening 100, region 62, fluid paths 58 and 60 to the outlet port 32. Since the outlet region is of a lower pressure than the inlet region, there will be a higher pressure in region 44 than in region 102, whereby diaphragm 52 is forced upward, moving sealing member 56 off of the valve seat 36 to open the valve and provide direct communication between the inlet port 30 through member 38, region 44 and opening 46 to the outlet port 32.

The valve portion of this embodiment, as hereinbefore described, may take on various forms and is by no way limited to the specific structure disclosed herein. In the particular embodiment disclosed, there is a momentary opportunity for leakage of fluid from region 62 around pin 68, and in order to avoid the build up of pressure under diaphragm 70 and the possible leakage of fluid into the magnetic actuator area, vent 104 is provided to vent this small amount of leakage outside of the device enclosure. In applications where such venting is not appropriate, such venting may be eliminated and/or the actuator-valve portion reconfigured as desired.

Figure 5:
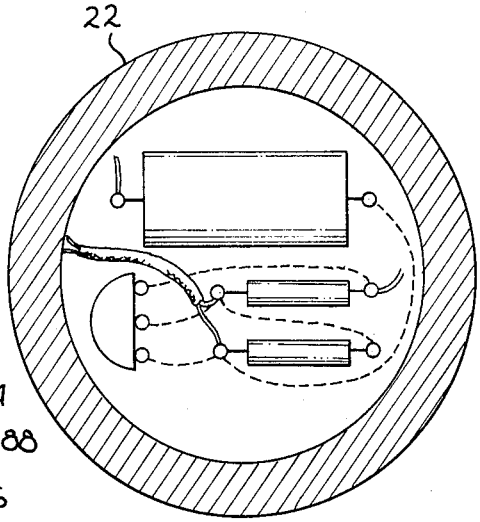
FIG. 5 is a cross section taken along line 5—5 of FIG. 4 illustrating the packaging of the various electronic components therein.

The electronics portion of the actuator of the present invention is generally housed in the upper body portion 22, as may be seen in FIG. 5. Various types of well known packaging techniques may be utilized as desired, the choice depending generally upon the specific driver circuit being packaged, the allowed space and the cost tradeoffs between the various suitable alternatives. The essential feature however, is that the electronics be contained within the latching actuator enclosure itself so that two wire operation is achieved, preferably with the same response to voltages on the two wires as would be achieved with a conventional nonlatching actuator, but with much less power consumption. By way of example, one circuit which has been used with the present invention may be seen in FIG. 6. The two input leads or terminals of the integrated latching actuator are represented by connections 106 and 108. Coupled in series between connections 106 and 108 are a diode 110, the actuator coil 94 and a capacitor 112. When the voltage on line 106 in comparison to the voltage on line 108 is stepped from zero to the operating voltage of the actuator, say, by way of example, to 24 volts, diode 110 is forward biased so that a pulse of current flows through coil 94, decaying to zero when capacitor 112 is charged to the input voltage between lines 106 and 108 (less the forward conduction voltage drop of diode 110). During this period, Darlington transistor pair 114 is biased to the off condition, as the base connection on line 116 is connected directly to the input line 106. In that regard resistor 118 is a relatively high valued resistor, so that the steady state power loss in resistor 118 is quite low.

The pulse of current through coil 94 when the voltage on line 106 is raised to the actuation voltage (24 volts in this example) is sufficient to latch the actuator as illustrated in FIG. 4. Consequently, so long as line 106 is held at the actuation voltage, the actuator will remain actuated without substantial power consumption, whereas an equivalent nonlatching actuator would constantly draw relatively high power throughout the entire time period that the actuator is kept in the actuated position. This results in at least three very substantial advantages in the present invention. In particular, there is a very direct and substantial power saving when the present invention is used as a replacement for any prior art actuators having any substantial duty cycle. Second, since the steady state power dissipation of the present invention actuator is very low when in the actuated state (and zero when in the unactuated state), the actuator of the present invention may be made much smaller and thus less expensively than the prior art nonlatching actuator which it may replace, as size per se and provision for heat dissipation is not a requirement of the present invention as it is with prior art actuators. Finally, the absence of substantial heat dissipation will reflect favorably on the life of the actuator, as chemical reactions, decomposition, etc., leading to failure of a component accelerate rapidly with temperature.

When the voltage between lines 106 and 108 is again stepped to zero (representing the step to the nonactuated state of prior art nonlatching actuators) diode 110 becomes back biased and therefore is effectively out of circuit. However, the essentially zero voltage differential between lines 106 and 108 turns on the Darlington pair 114 so that capacitor 112 discharges through coil 94, the Darlington pair and resistor 120 to provide a current pulse opposite in direction to the earlier current pulse and of a lesser amplitude, as limited by the voltage drop of the Darlington pair 114 and the voltage drop across resistor 120. Thus the pulse in the reverse direction is of a controlled lesser amplitude selected to result in the demagnetization of the magnetic circuit in accordance with the teachings of the hereinbefore referred to patents.

In many applications, the off signal to an actuator is represented by a simple open created by the opening of the switch connecting the actuator to a power supply for actuation purposes. In such a situation, line 106 (or line 108) will simply go open rather than lines 106 and 108 being pulled to the same (or zero) voltage. For this purpose resistor 118 is provided which pulls lines 106 and 108 to the same voltage upon the opening of such an actuation switch circuit. Resistor 118 of course also assures that in the event of loss of power for any reason, such as by way of example, a loss of main power or the breaking of one of the lines to the actuator, the actuator will trip to the unlatched state, as would a prior art nonlatching actuator upon loss of power.

Figure 6:
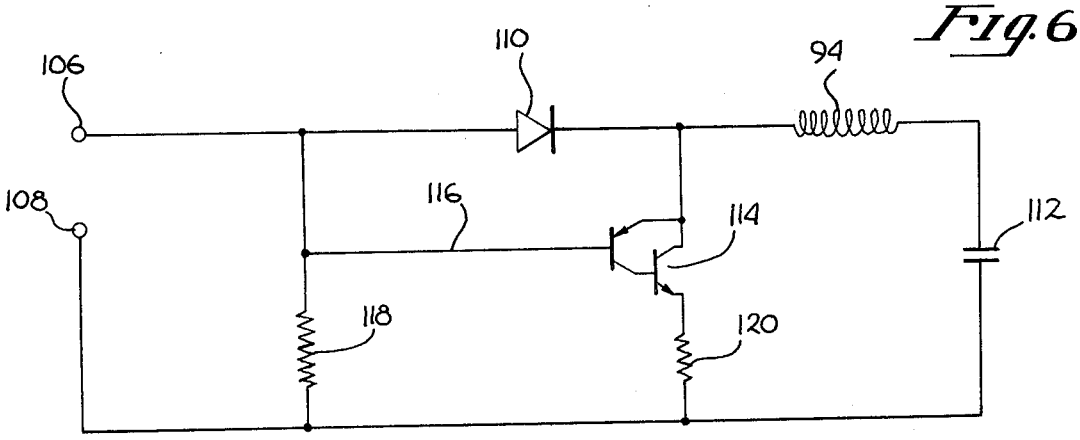
FIG. 6 is circuit diagram illustrating a first embodiment circuit used for the present invention.
Figure 7:
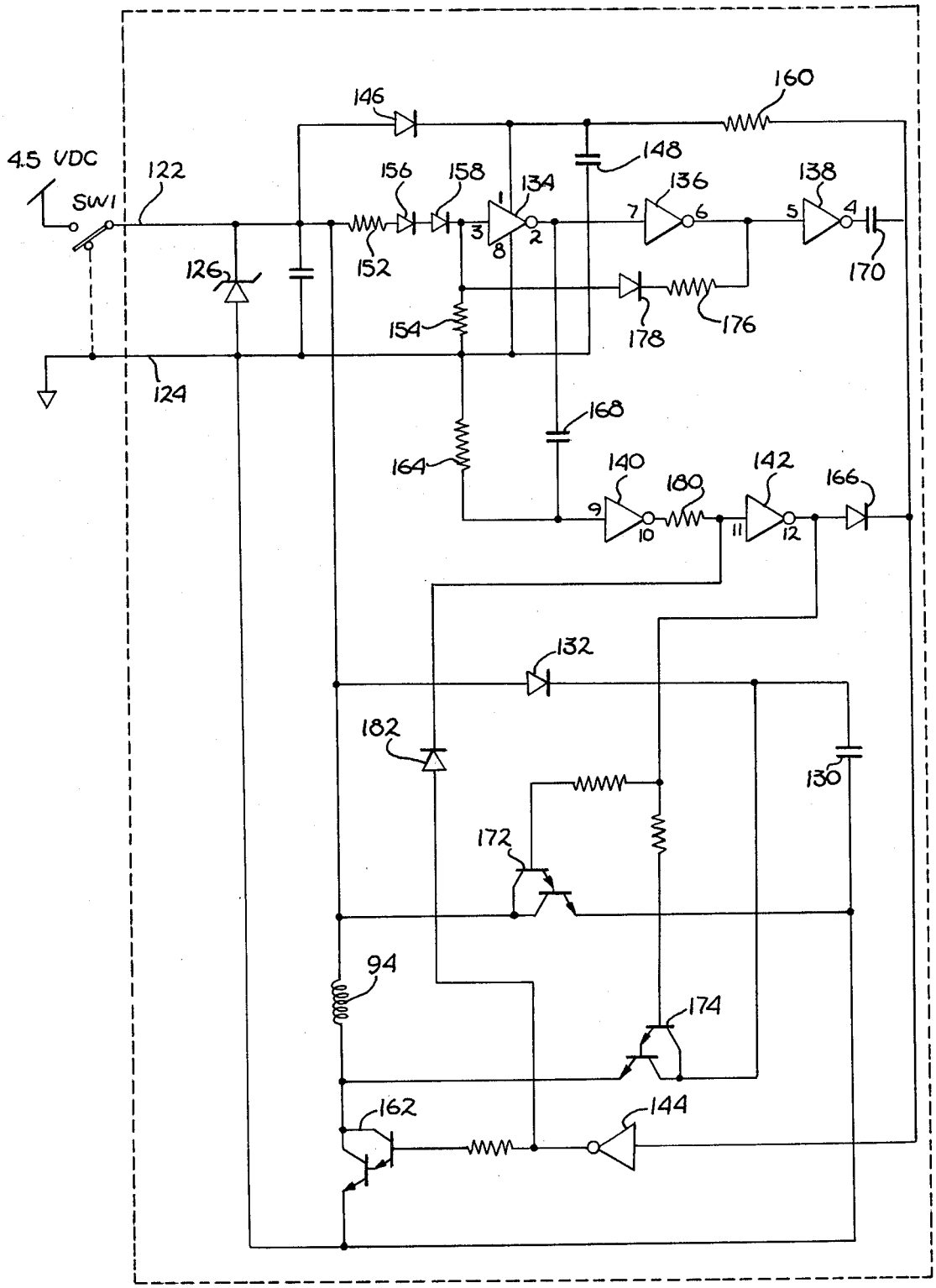
FIG. 7 is a circuit diagram of an alternate circuit.

The proper operation of the circuit of FIG. 6 depends upon relatively sharp turn on and turn off voltages applied to lines 106 and 108, or alternatively a fairly positive switch opening and closure coupling lines 106 and 108 to the actuating power source. in some instances however, such sharp transitions cannot be assured, in which case alternate circuitry such as that shown in FIG. 7 may be used to assure proper operation, even in the presence of much more slowly varying actuation signals. In particular, in FIG. 7 a circuit is shown within the dashed line which, when packaged as part of the integrated actuator of the present invention, will provide proper operation of the device independent of the rate at which the voltage on the input lines, this time labeled lines 122 and 124, rises for actuation or falls for unlatching. In the circuit a zener diode 126 is placed directly across the two input lines to provide reverse bias voltage protection for the circuit and to provide a means for overvoltage protection and/or detection on devices returned under warranty.

Assume for the moment that there is no voltage between lines 122 and 124 and that the actuator is unlatched. If the voltage on line 122 is slowly raised with respect to the voltage on line 124, capacitor 130, the main storage capacitor for providing pulses of current through the actuator coil 94 for unlatching purposes is slowly charged through diode 132. Also a hex inverter comprised of inverters 134, 136, 138, 140, 142 and 144 will become operative as a result of power being supplied thereto through diode 146 to charge capacitor 148 when the input voltage reaches a level still well below the actuation voltage. Initially the input to inverter 134 will be held low as a result of resistors 152 and 154 and the drop in diodes 156 and 158.

With the input to inverter 134 low, the output of inverter 138 is high, with the input to inverter 144 also being high as a result of resistor 160. Thus the output of inverter 144 coupled to Darlington switch 162 is low, holding the switch in the off condition. As the input voltage continues to increase, capacitor 130 will become adequately charged to have sufficient energy to assure the completion of a subsequent release or unlatching cycle.

As the input voltage on line 22 continues to rise, either quickly or slowly, the input to inverter 134 will go high. Coupling through capacitor 168 merely drives the input to inverter 140 further low, not affecting the output thereof. However, the output of inverter 136 will now go high and the output of inverter 138 low, pulsing the input to inverter 144 low with a time constant determined by capacitor 170 and resistor 160, preferably approximately 15 milliseconds. Thus the output of inverter 144 is pulsed high for approximately 15 milliseconds, turning on switch 162 to couple the actuator coil 94 directly across lines 122 and 124 for a sufficient length of time to actuate and latch the actuator. Thereafter the input to inverter 144 will again go high, turning off switch 162. Consequently, with full input voltage across lines 122 and 124, the actuator is actuated and latched with the current through coil 94 being turned off after the latching cycle. (In the preferred embodiment the system is operative on a 4½ volt DC input, with line 122 being the positive line with respect to line 124, though obviously the circuit could readily be varied to accept other voltages, or by way of further example, could include a full wave rectifier at the input thereof for unpolarized and/or AC operation.)

When the voltage on line 122 starts dropping, either quickly or slowly, at the start of a release cycle, the input to inverter 134 will go low well before the inverters themselves become inoperative because of an excessive drop in the voltage across capacitor 148. This results in the output of inverter 134 going high, pulsing the output of inverter 140 low for approximately 15 milliseconds, as determined by the RC time constant of resistor 164 and capacitor 168. When the output of inverter 140 is driven low, the output of inverter 142 goes high, turning on switches 172 and 174 coupling capacitor 130 directly across coil 94, though this time with the positive voltage of capacitor 130 being applied through switch 174 to the lower end of coil 94 (as it appears in FIG. 7) as opposed to the upper end of coil 94 for the actuating pulse. Thus it may be seen from the circuit of FIG. 7 that an increase of the voltage between lines 122 and 124 from a low state toward a high state, whether slowly or quickly, results first in the storage of adequate electrical energy 130 to assure the proper unlatching of the actuator in a subsequent unlatching cycle, followed by the latching of the actuator, and a decrease of the voltage betweens line 122 and 124 from the high state toward the low state, whether quickly or slowly, will result in the triggering of the unlatching cycle prior to the circuit becoming inoperative as a result of loss of power. Thus the circuit of this figure is not sensitive to the rate of increase or decrease of the input voltage.

Also shown in FIG. 7 is a resistor 176 and diode 178 which provide a form of Schmidt feedback to enhance the operation of the circuit as hereinbefore described. Also resistor 180 and diodes 182 and 166 provide a lockout function to prevent any opportunity of initiating the turn on and the turn off pulses simultaneously should the device input be pulsed faster than device response time.

Figure 8:
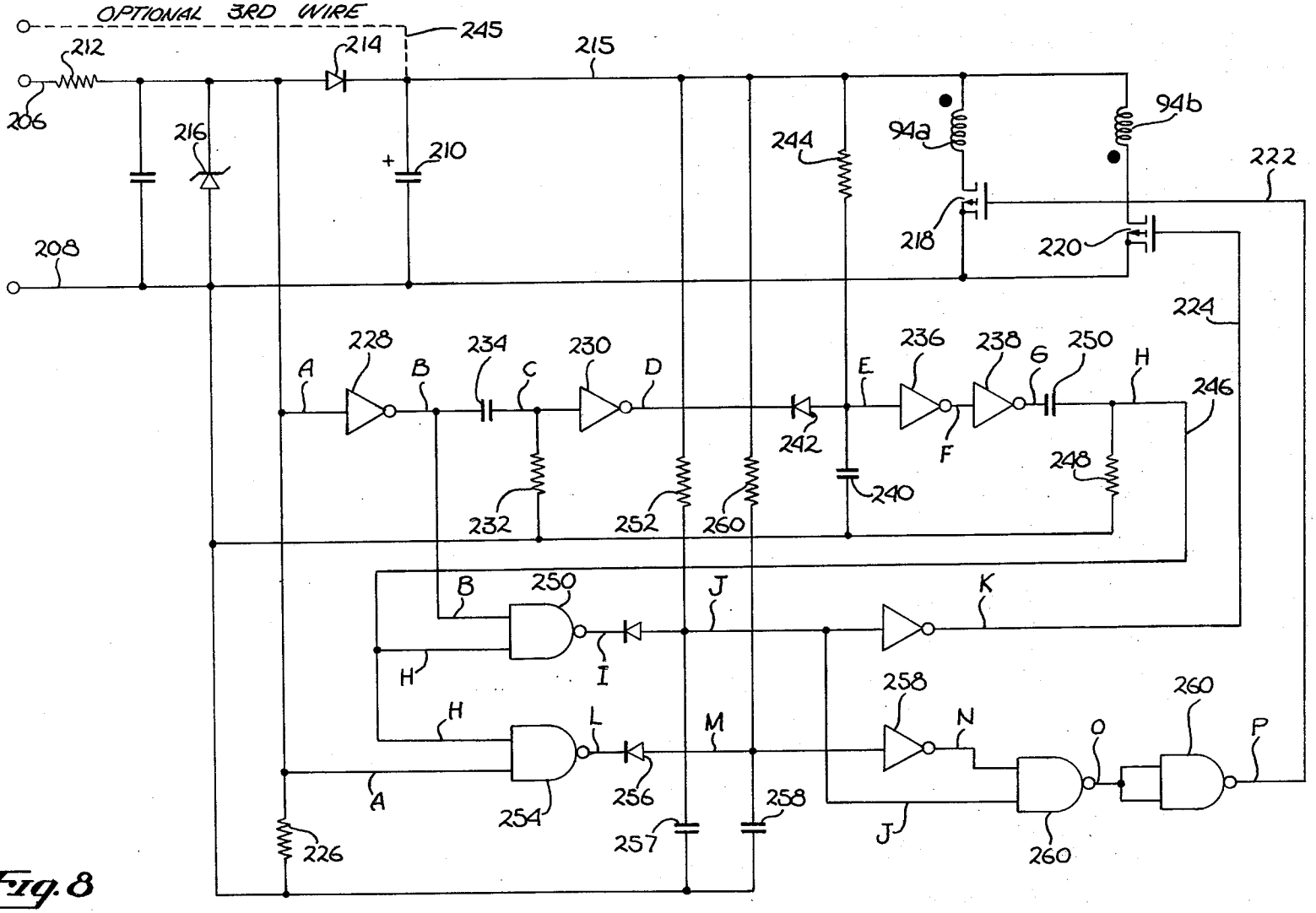
FIG. 8 is a circuit diagram for a still further alternate circuit.
Figure 9:
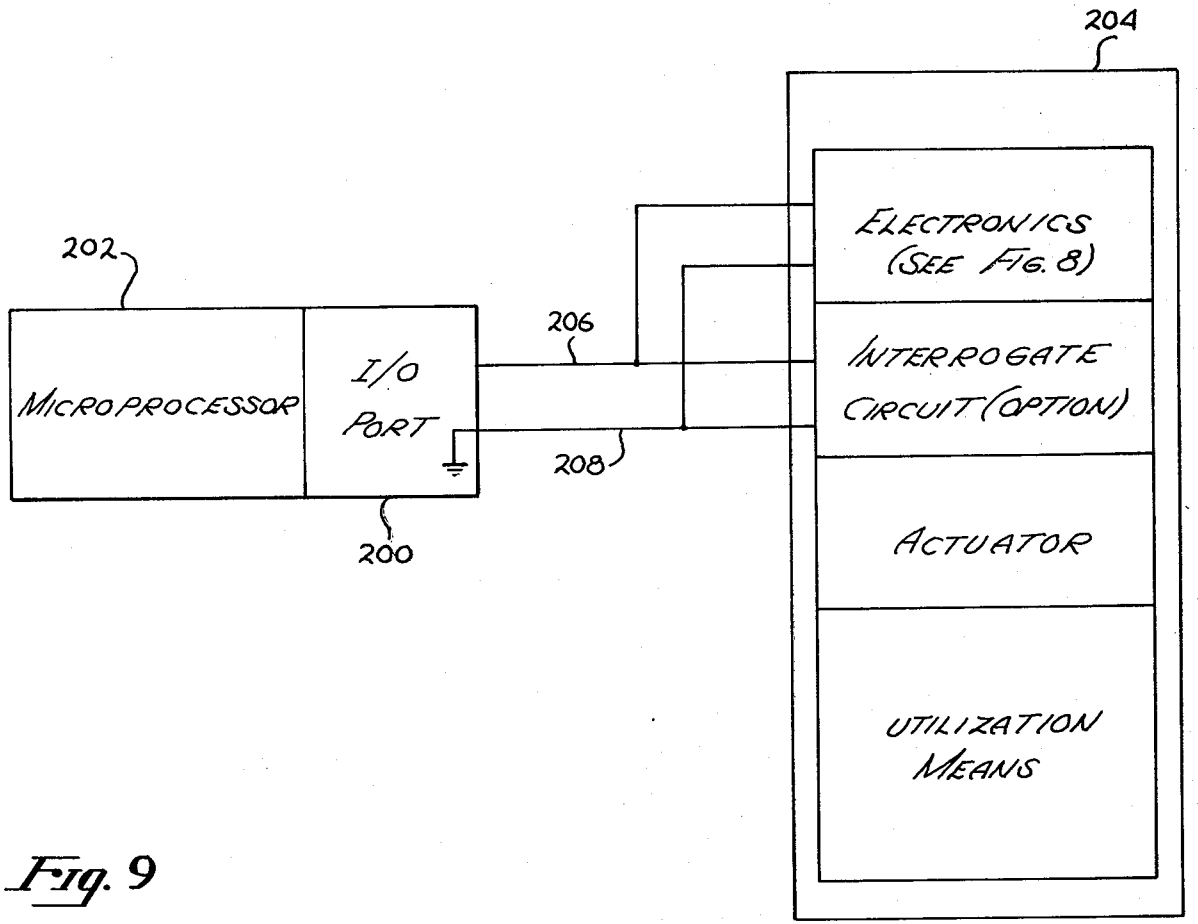
FIG. 9 is a block diagram illustrating a system which may include an interrogate circuit option for monitoring the operation of the integrated latching actuator under program control.

Now referring to FIG. 8, a still further embodiment of the present invention may be seen. This embodiment may be operated directly on microprocessor peripheral interface adapter outputs, or even directly from single chip microcomputers without any separate power supply for the electronics or the actuator. Consequently, the relatively expensive driver circuits and required power supply, etc., characteristic of prior art actuators is eliminated by the use of this embodiment. A typical system which might use an embodiment comprising the circuit of FIG. 8 is shown in FIG. 9. In that diagram, the I/O port (input/output port) 200 of microprocessor 202 has one line thereof 206 coupled to the electronics of FIG. 8 in the actuator 204. A second line 208 represents the return line and is coupled to the power ground of the microprocessor system. (Alternatively line 206 could be coupled to the positive power supply as available on the microprocessor bus, with line 208 being coupled to the output port line.) Thus the integrated actuator 206 is operative directly upon one of the outputs of the I/O port.

By way of specific examples, the microprocessor might be an 8085 microprocessor manufactured by Intel Corporation, with the I/O port being one of the output lines of an 825X-5 peripheral device, such as the 8255A-

5 programmable peripheral interface. By way of another specific example, the microprocessor 202 might be an Intel 8021 single chip, eight bit microcomputer, with the I/O port 200 comprising one of the I/O lines on the 8021 microcomputer itself. In that regard, it may be noted that the 8021 has two eight bit quasi-bidirectional ports (as well as other ports), specifically port zero (P00–P07) and port one (P10–P17). Lines P10 ad P11 of port one comprise high current output lines capable of sinking 7 milliamps at VSS=2.5 volts. These pins may also be paralleled for 14 milliamp drive if the microcomputer is programmed so that the output logic states of these two pins are always the same. For the 8021 connection, line 206 would be coupled to the five volt supply for the microprocessor, whereas line 208 would be tied to one or both of pins P10 and P11, as the high current capability of P10 and P11 in the 8021 is a sink capability rather than a source capability. In that regard in the description to follow, it will be presumed that the specific microprocessor and I/O port being used, whether part of the microprocessor itself or a peripheral interface adapter for the microprocessor, is a source rather than a sink so that line 208 in the explanation to follow will be considered to be at ground potential and line 206 will be considered to be controllable under program control between ground and approximately five volts to act as a source of at least a few milliamp delivery capability. Obviously, however, this is for reference purpose only and by no way a limitation of the invention.

In the normal quiescent state, line 206 is held high with respect to line 208, i.e., the full output voltage of the microprocessor I/O of approximately five volts is applied between lines 206 and 208.

When line 206 is high, storage capacitor 210, the primary energy storage capacitor, is charged through resistor 212 and diode 214, the diode 214 blocking the capacitor 210 when line 206 goes low so that line 215 will stay high after line 206 goes low. Typically capacitor 210 will be on the order of 1,000 to 2,200 microfarads, with resistor 212 chosen to be as low as reasonably possible without exceeding the current output (load impedence) limitations of the I/O line of the microprocessor device. By way of specific example, if resistor 212 is a 22 ohm resistor and capacitor 210 is a 2200 microfarad capacitor, the RC time constant of this combination will be approximately 50 milliseconds, illustrating that the capacitor will reach its maximum charge in most instances in a few hundred milliseconds. In those applications where higher repetition rates are necessary, provision is made for an optional third wire, line 245, to connect capacitor 210 directly to the power supply of the associated processor. As before, zener diode 216 provides overvoltage protection and/or detection. In this quiescent state, both switching devices 218 and 220 are in the off condition. In that regard, this embodiment of the actuator uses two coils **94*a* and 94*b*, both coils being wound on the same spool, coil 94*a* being used for the turn on or latching pulse and coil 94*b*, having a reverse winding sense, being used for the turn-off pulse. Thus, in this quiescent state, lines 222 and 224** are in the low state.

The circuit of FIG. 8 is activated by line 206 going low with predetermined characteristics. More specifically, if line 206 goes low for approximately 40 microseconds and returns to the high state, the circuit of FIG. 8 will detect this, providing a 15 millisecond pulse on line 222 to turn on switch 218 to couple coil **94*a* across the charged capacitor 210 to latch the actuator. If on the other hand line 206 goes low and remains low for approximately 100 microseconds or longer (either under microprocessor control or as a result of power failure or lead breakage) the circuit of FIG. 8 will sense this also, pulsing line 224 to turn on switch 220, coupling the unlatching coil 94*b* across the capacitor 210 for approximately 15 milliseconds to release the actuator. (With respect to an open lead condition, resistor 226 acts as a pulldown resistor for line 206**.)

Figures 10, 11, 12:
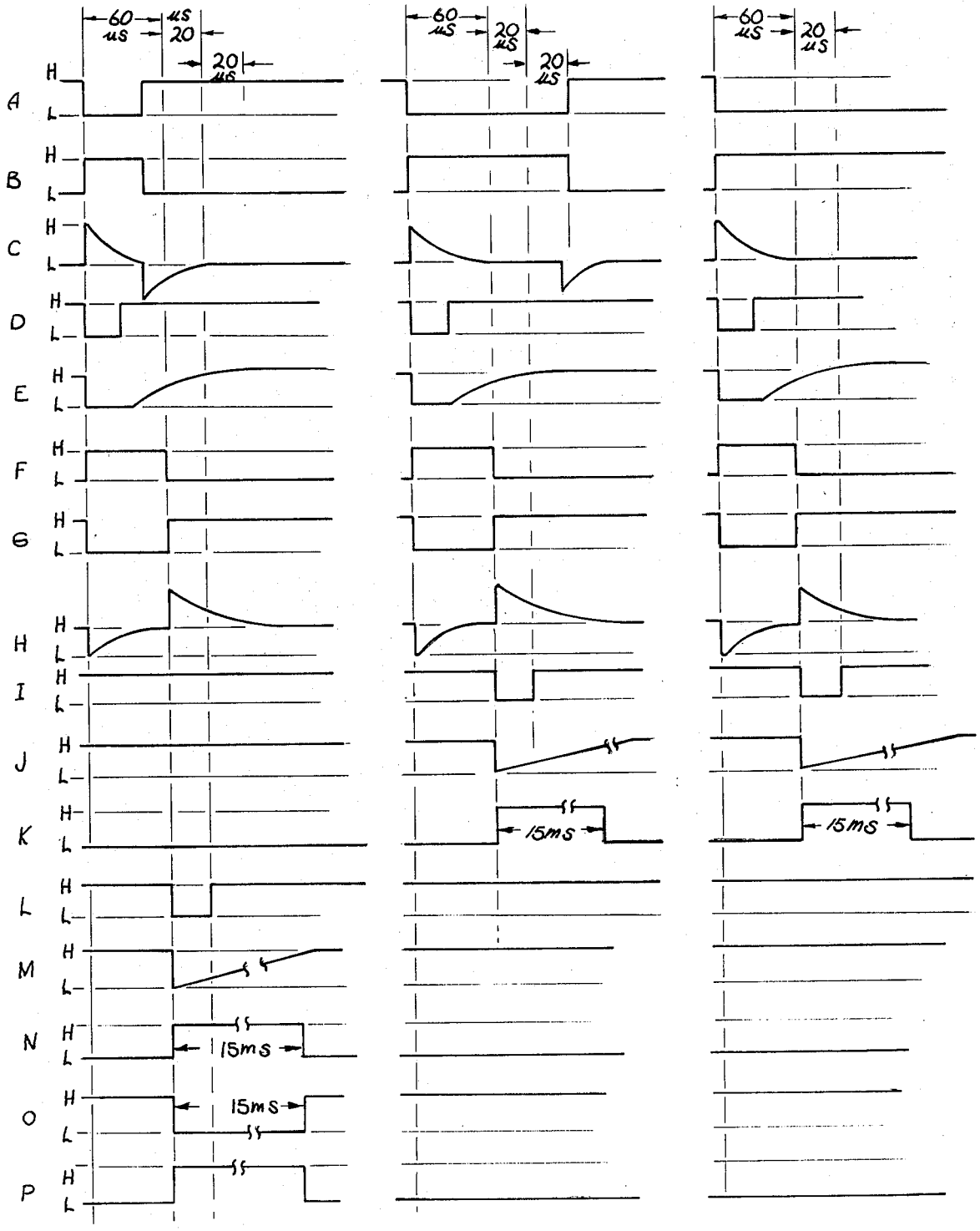
FIGS. 10 through 12 are waveform diagrams illustrating the waveform of various signals inherent in the circuit of FIG. 8 for the actuate mode, the release mode and a typical failure mode of the integrated latching actuator.

In FIGS. 10, 11 and 12 the general wave shapes of the signals of lines A through P as identified in FIG. 8 may be seen. In each of these figures it is presumed at Time T0 that line 206 goes low, initiating either the actuate cycle illustrated in FIG. 10, the release cycle illustrated in FIG. 11 or an open or failure mode illustrated in FIG. 12. Referring first to FIG. 10 illustrating the actuate mode, when line 206 initially goes low after having been at the high state for at least a few hundred milliseconds, line A generally follows line 206. The output of inverter 228 on line B goes high, pulsing line C which is the input to inverter 230 high, line C having the decaying wave shape shown as a result of the RC combination of resistor 232 and capacitor 234. Thus the output of inverter 230 on line D is pulsed low, returning to the high state in approximately 20 microseconds in the preferred embodiment. When pulsed low, the output of inverter 230, i.e., line D, pulls line E low also through diode 244 so that the output of inverter 236 on line F goes high and line G, the output of inverter 238 goes low. As mentioned, after approximately 20 microseconds, line C decays sufficiently low so that line D goes high, decoupling lines D and E by the back biasing of diode 242, allowing capacitor 240 to charge through resistor 244. The various RC time constants are set so that line E will not go sufficiently high to drive the output of inverter 236 on line F low until approximately 60 microseconds after line A initially went low. Thus line E effectively goes high after approximately 60 microseconds from the start, driving line F low and line G high, creating a positive pulse on line H which decays as a result of the RC time constant of resistors 48 and capacitor 250.

The inputs to NAND gate 250 comprise the signals on lines B and H. If line A has returned high in less than 60 microseconds, signaling an actuation command, line B returns low within 60 microseconds so that both line B and line H are not high at the same time. Consequently, the output of NAND gate 250 remains high, line J remains high as a result of resistor 252 being tied to line 15 (which is maintained high by capacitor 210) and line K remains low. Consequently, semiconductor switch 220 controlling the release coil **94*b* remains off during this sequence. The inputs to NAND gate 252 on the other hand, are the signals on lines A and H. It will be noted that the signal on line A is the inverse of the signal on line B and accordingly, both A and H are high after 60 microseconds, with line H decaying to the low state after approximately another 20 microseconds. Consequently, line L is pulsed low for approximately 20 microseconds, pulling line M low through diode 256. When line L returns high, capacitor 257 begins charging through resistor 252, this resistor-capacitor combination having a relatively long time constant so that line M will remain low on the order of 15 milliseconds. Thus the output of inverter 258 on line N goes high for approximately 15 milliseconds, and since line J has been kept high throughout this time period, line O comprising the output of NAND gate 260 goes low for approximately 15 milliseconds and accordingly, the output of NAND gate 262 on line P goes high for approximately 15 milliseconds, pulsing switch 218** on. This 15 millisecond time period represents the current pulse time requirement for actuation of the magnetic actuator and of course may be varied as desired, dependent upon the physical characteristics of the actuator itself. In this embodiment the pulse terminates after 15 milliseconds so that the system returns to the substantially zero power quiescent state.

It will be noted that the inputs to NAND gate 250 comprise the signals on lines B and H whereas the inputs to NAND gate 254 comprise the signals on lines A and H. Further, it will be noted that the signals on lines A and B are the inverse of each other in that the signal on line A is inverted by inverter 228 to directly appear on line B. Consequently if line 206 is not brought low within 60 microseconds after the signal on line A, i.e., the input signal goes low, then A and H wll not both be high after 60 microseconds so that switch 218 will not be pulsed on. However, B and H will both be high after 60 microseconds as is illustrated in FIG. 11, so that the output I of NAND gate 250 will be pulsed low, pulling line J low through diode 261. As with line M, line J is coupled through resistor 252 and capacitor 263 to provide a substantial time constant for line J so that the low signal on line J may be inverted by inverter 264 to pull line K high for approximately 15 milliseconds, pulsing switch 220 on for approximately 15 milliseconds to carry out the unlatching cycle. Thus it may be seen that the distinction between an actuating and releasing cycle is that in the case of an actuating cycle, the control line (which also is a power line) is driven low for less than 60 microseconds, preferably approximately 40 microseconds in the preferred embodiment to carry out the actuation cycle, whereas the release cycle is initiated by the input line going low for more than 60 microseconds, preferably approximately 100 microseconds. As a special case however, the input or control signal may go low for various reasons such as an intentional or unintentional turn off of power to the main system, a break in one of the lines 206 and 208, etc. In such event, of course, the control signal is held low for more than 60 microseconds and accordingly, in such event the electronics of FIG. 8 will also release the actuator as is illustrated in FIG. 12. The net result is that the actuator responds to input signals in a manner identical to prior art nonlatching actuators but does so with negligible power consumption and with a supply directly from microprocessor output signals, such as from PIAs (peripheral interface adapters) or from one or more output lines of a single chip computer.

Referring again to FIG. 9, it will be noted that this embodiment, aside from the electronics and actuator, incorporates some utilization means such as a valve, relay switch, etc. An interrogate circuit may be provided which allows the actuator not only to be actuated and released through lines 206 and 208, but to also be tested through these same lines to be sure that a previous command had been carried out. In particular, it should be noted that an actuation current pulse on a previously unlatched actuator will have a current waveform which is substantially different from that of an actuation pulse on an already actuated actuator. Similarly a release pulse on a latched actuator will have a substantially different current waveform than a release pulse on an already released actuator. Consequently, the interrogate circuit 302 may take any of a number of forms. By way of specific example, the characteristics of the latching and releasing cycles may be noted and retained in the interrogate circuit to be sensed through lines 206 and 208 at a subsequent time. For instance, the microprocessor could very easily be programmed to convert the drive line for the integrated latching actuator to an input line immediately after an actuation or release cycle has been completed, with the interrogate circuit providing an output indicative of the state of the actuator as sensed during the previous operating cycle. In this manner, the state of the actuator can be made known at all times, and if the actuator fails to respond to some particular control signals, such failure will be noted, and depending upon the application, an alarm may be sounded and/or another attempt to execute the operating cycle can be immediately made under program control. This is a highly useful feature in microprocessor based systems, not only because it provides a self test feature and automatic failure warning capabilities, but also because it allows automatic attempts to correct the failure under program control, and further allows the shut down of the system and/or compensation for the failure through other controls, all executable under program control without the immediate intervention of an operator.

There have been described herein various embodiments of integrated latching actuators which may be used as high reliability, low cost and low power consumption replacements for conventional two wire solenoid actuators of the nonlatching kind. Various embodiments of these actuators have been disclosed such as embodiments intended for use with a positively switched on/off control, with possibly slowly changing on/off control signals and with direct microprocessor or single chip computer drive, in which case an interrogate function may be included. It is to be understood however, that these specific embodiments and the specific utilization means disclosed, i.e., a pilot operated valve, have been disclosed simply as exemplary embodiments of the invention, as it will be understood by those skilled in the art that various changes in form and detail may be made therein without departing from the spirit and scope of the invention.

We claim:

1. An integrated latching actuator comprising an actuator having a stationary magnetic member, at least one coil, a moveable magnetic member and a return means, said stationary magnetic and said moveable magnetic member forming a magnetic circuit, said moveable magnetic member being moveable with respect to said stationary magnetic member between a first latched position and a second unlatched position, said at least one coil being disposed in said magnetic circuit so that a first current pulse therein magnetizes said magnetic circuit and encourages said moveable magnetic member to said first position wherein the retentivity of said magnetic circuit will maintain said moveable magnetic member at said first position, and a second current pulse therein substantially demagnetizes said magnetic circuit, said return means being a means for encouraging said moveable magnetic member to said second position upon substantial demagnitization of said magnetic circuit circuit means having first and second electrical connections and being coupled to said at least one coil, said circuit means being a means responsive to a first predetermined voltage sequence applied to said electrical connections to provide said first current pulse to said at least one coil, and responsive to a second predetermined voltage sequence applied to said electrical input connections to provide said second current pulse to said at least one coil, wherein said first predetermined voltage sequence is the application of a substantially nonzero voltage, the removal of said substantially nonzero voltage for a period less than a predetermined time period, followed by the reapplication of the substantially nonzero voltage enclosure means containing said actuator and said circuit means, said first and second electrical input connections being accessible outside said enclosure means.

2. The integrated latching actuator of claim 1 wherein said second predetermined voltage sequence is the application of a substantially nonzero voltage for a period greater than a predetermined time period.

3. The integrated latching actuator of claim 2 wherein said second predetermined voltage sequence may be followed by the reapplication of the substantially nonzero voltage.

4. The integrated latching actuator of claim 3 wherein said circuit means is further responsive to an open circuit on said electrical connections to provide said second current pulse.

5. The integrated latching actuator of claim 1 wherein said circuit means is operative directly from single chip computer and microprocessor output port signals.

6. An integrated latching actuator comprising an actuator having a stationary magnetic member, at least one coil, a moveable magnetic member and a return means, said stationary magnetic and said moveable magnetic member forming a magnetic circuit, said moveable magnetic member being moveable with respect to said stationary magnetic member between a first latched position and a second unlatched position, said at least one coil being disposed in said magnetic circuit so that a first current pulse therein magnetizes said magnetic circuit and encourages said moveable magnetic member to said first position wherein the retentivity of said magnetic circuit will maintain said moveable magnetic member at said first position, and a second current pulse therein substantially changes the magnetization of said magnetic circuit, said return means being for encouraging said moveable magnetic member to said second position upon substantial change of magnetization of said magnetic circuit circuit means having first and second electrical connections and being coupled to said at least one coil, said circuit means being a means responsive to a first predetermined voltage sequence applied to said electrical connections to provide said first current pulse to said at least one coil, and responsive to a second predetermined voltage sequence applied to said electrical input connections to provide said second current pulse to said at least one coil, said first and second predetermined voltage sequences each starting and ending with the application of a substantially nonzero voltage to said electrical connections enclosure means containing said actuator and said circuit means, said first and second electrical input connections being accessible outside said enclosure means.

7. The integrated latching actuator of claim 6 wherein said circuit means is a means responsive to a substantially nonzero voltage to store sufficient energy at relatively low storage current levels to provide said first and second current pulses in response to said first and second voltage sequences respectively.

8. The integrated latching actuator of claim 7 wherein said circuit means is operative directly from single chip computer and microprocessor output port signals.

9. The integrated latching actuator of claim 7 wherein said circuit means is further responsive to an open circuit on said electrical to provide said second current pulse.

10. The integrated latching actuator of claim 7 wherein said first predetermined voltage sequence is the application of a substantially nonzero voltage, the removal of said substantially nonzero voltage for a period less than a predetermined time period, followed by the reapplication of the substantially nonzero voltage.

11. The integrated latching actuator of claim 10 wherein said second predetermined voltage sequence is the application of a substantially nonzero voltage for a period greater than a predetermined time period.

* * * * *

UNITED STATES PATENT AND TRADEMARK OFFICE

CERTIFICATE OF CORRECTION

PATENT NO. : 4,409,638

DATED : 10/11/83

INVENTOR(S) : Sturman ET AL.

It is certified that error appears in the above-identified patent and that said Letters Patent is hereby corrected as shown below:

| COLUMN | LINE | DESCRIPTION |
|---|---|---|
| 9 | 8 | Delete "ad" and insert --and-- |

Signed and Sealed this

Thirty-first Day of May, 1988

*Attest:*

DONALD J. QUIGG

*Attesting Officer*

*Commissioner of Patents and Trademarks*